US010597854B1

(12) United States Patent
Wang et al.

(10) Patent No.: US 10,597,854 B1
(45) Date of Patent: Mar. 24, 2020

(54) SENSING FAUCET FOR INTEGRATION OF SOAP SUPPLY WITH WATER EXIT

(71) Applicants: Hsiang-Hung Wang, Lukang Township, Changhua County (TW); Yu-Chang Lin, Lukang Township, Changhua County (TW)

(72) Inventors: Hsiang-Hung Wang, Lukang Township, Changhua County (TW); Yu-Chang Lin, Lukang Township, Changhua County (TW)

( * ) Notice: Subject to any disclaimer, the term of this patent is extended or adjusted under 35 U.S.C. 154(b) by 0 days.

(21) Appl. No.: 16/387,563

(22) Filed: Apr. 18, 2019

(51) Int. Cl.
*E03C 1/046* (2006.01)

(52) U.S. Cl.
CPC ..... *E03C 1/0465* (2013.01)

(58) Field of Classification Search
CPC ..... E03C 1/0465
USPC ..... 222/52, 63, 132, 135, 145.5, 190
See application file for complete search history.

(56) References Cited

U.S. PATENT DOCUMENTS

| | | | | |
|---|---|---|---|---|
| 7,228,874 | B2 * | 6/2007 | Bolderheij | E03C 1/04 137/801 |
| 7,458,523 | B2 * | 12/2008 | Hyslop | E03C 1/0404 239/67 |
| 9,526,380 | B2 * | 12/2016 | Hamilton | A47K 5/1217 |
| 9,777,468 | B2 * | 10/2017 | Burgo, Sr. | E03C 1/0404 |
| 9,945,104 | B2 * | 4/2018 | Wang | A47K 5/14 |
| 2008/0121660 | A1 * | 5/2008 | Ophardt | A47K 5/16 222/190 |
| 2015/0259890 | A1 * | 9/2015 | Shirai | E03C 1/057 4/668 |
| 2017/0218605 | A1 * | 8/2017 | Wang | E03C 1/046 |

* cited by examiner

*Primary Examiner* — Vishal Pancholi
(74) *Attorney, Agent, or Firm* — Leong C. Lei

(57) ABSTRACT

A sensing faucet for the integration of soap supply with water exit includes a main body configured with a mounting portion having a first mounting zone and second mounting zone, where the first mounting zone is used to accept a water supply module, and the second mounting zone a soap supply module, where an obtuse angle is formed between the first and second mounting zones. With the above structure, the soap supply module can conform to a human factor design besides the water and soap supply modules are integrated with each other in the same sensing faucet, allowing users direct soap supply according hand washing habits without needing to touch any other components, and the hand cleaning convenience can then be achieved.

1 Claim, 6 Drawing Sheets

A-A cross-sectional view

B-B cross-sectional view

SENSING FAUCET FOR INTEGRATION OF SOAP SUPPLY WITH WATER EXIT

TECHNICAL FIELD OF THE INVENTION

The present invention relates to a sensing faucet for the integration of soap supply with water exit, and more particularly to a sensing faucet for the integration of soap liquid with water exit configuring a water supply module and soap supply module on the same main body so as to improve use convenient and conform to use habit.

DESCRIPTION OF THE PRIOR ART

In modern society, general people pay great attention to cleaning and sanitation. In bathroom spaces, a variety of soap dispensers are always placed next to faucets for body cleaning and avoiding germs that are harmful to health.

To solve the above, there is a Taiwan Patent No. M523797, titled "faucet structure for provision of soap with infrared light", in which space is saved and environment is kept neat, clean and not messy.

Other related patent documents such as U.S. patent application Ser. No. 11/717,549 and Ser. No. 14/615,138 all describe the design concept of the installment of faucets and foaming soap dispensers on a sink, but the above structures are rather awkward in appearance and not easily accepted by the market in order to allow water tubes and pipeline for a soap dispenser to be installed inside it. In addition, it is rather not in conformity with the design of human factor engineering, causing their uses to be not smooth. Especially, in this case, a 4-inch double-hole wash-hand basin is required such that when a user wants to use the products of the above patent documents, it must be replaced together with the wash-hand basin, which increase the cost significantly.

In addition, the faucet products available in some countries are designed to control water and hand washing foam supplies through a projection sensing technology; these products are good intentions, but too many sensing gestures are inconvenient in use to users because most people want water and hand washing foam supplies to be intuitive, simple and convenient without needing too much control. Therefore, the above products are almost hardly seen in public, because they are not intuitive and convenient enough.

SUMMARY OF THE INVENTION

The main object of the present invention is to provide a sensing faucet for the integration of soap supply with water exit, integrating faucet with a soap supplier, and the soap supply outlet of the soap supplier is configured at another side of a water outlet; the entire faucet conforms to human factor engineering in use so that the action of hand washing is smooth and the volume of the structure is almost not different from the ones of current faucets.

To achieve the above object, the present invention is to propose a sensing faucet for integration of soap supply with water exit, including a main body, water supply module and soap supply module, the water supply module and soap supply module installed on the main body, the main body being an approximately L-shaped structure and including an extension portion and mounting portion; the water module including a water exit unit and water supply sensing unit, the water supply unit in connection with a water supply pipe and controlled by the water sensing unit to supply water, and the soap supply module installed on the second mounting zone and including a soap supply unit and soap supply sensing unit, the soap supply sensing unit adapted to control the soap supply unit to provide soap liquid, and the soap supply unit supplying soap liquid through a soap supply pipe, wherein the main body is configured with a first mounting zone and second mounting zone, the first mounting zone is used for the installment of the water supply module, the second mounting zone the soap supply module, the second mounting zone is a structure with an inclined surface formed by obliquely cutting one side of the mounting portion, an obtuse angle is formed between the first mounting zone and second mounting zone, allowing an included angle between the first mounting zone and second mounting zone to be ranged from 91° to 150° to conform to users' hand washing intuition and habit.

Therefore, the above structure is characterized in that when a user puts one hand close to one side of the second mounting zone, the soap supply sensing unit detects the hand is near the faucet, and the soap supply unit can then be used to provide the user with soap liquid, and user then puts the hand close to the water supply sensing unit after rubbing the hands with the soap liquid to cause tap water to flow out of the water exit unit to wash the hands.

In addition, the present invention integrates the water supply module with the soap supply module in one single main body; the appearance of the main body is almost not different from the ones of general faucets, enabling the beautification of the environment.

Furthermore, the volume reduction of the main body significantly enables the production cost to be reduced and the product profit to be increased.

Furthermore, the present invention conforms to the design of human factor engineering, when hands reach the first mounting zone, the water supply module will then provide clean water for hand washing; similarly, when one hand reaches the second mounting zone, foam (soap liquid) will then be provided such that it is very intuitive in use without needing to instruct users how to use. Therefore, when the present invention is applied in public, personal hygiene can be further improved.

In a preferred embodiment, the water supply sensing unit and soap supply sensing unit of the present invention are further controlled by a control board to supply water or soap liquid.

The present invention is further characterized in that when the water supply sensing unit and soap supply sensing unit sense one hand or hands are being close at the same time, tap water and soap liquid will not be supplied simultaneously; in another words, only tap water or only soap liquid will be provided at any time.

DETAILED DESCRIPTION OF THE PREFERRED EMBODIMENTS

Figure 1:
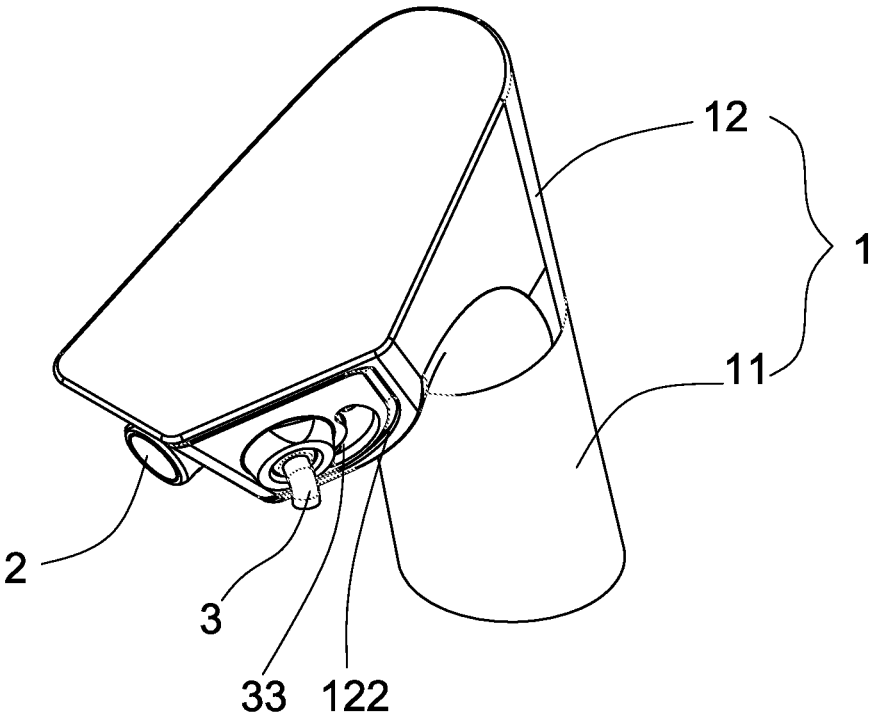
FIGS. 1 and 2 respectively are a perspective view of the present invention.
Figure 2:
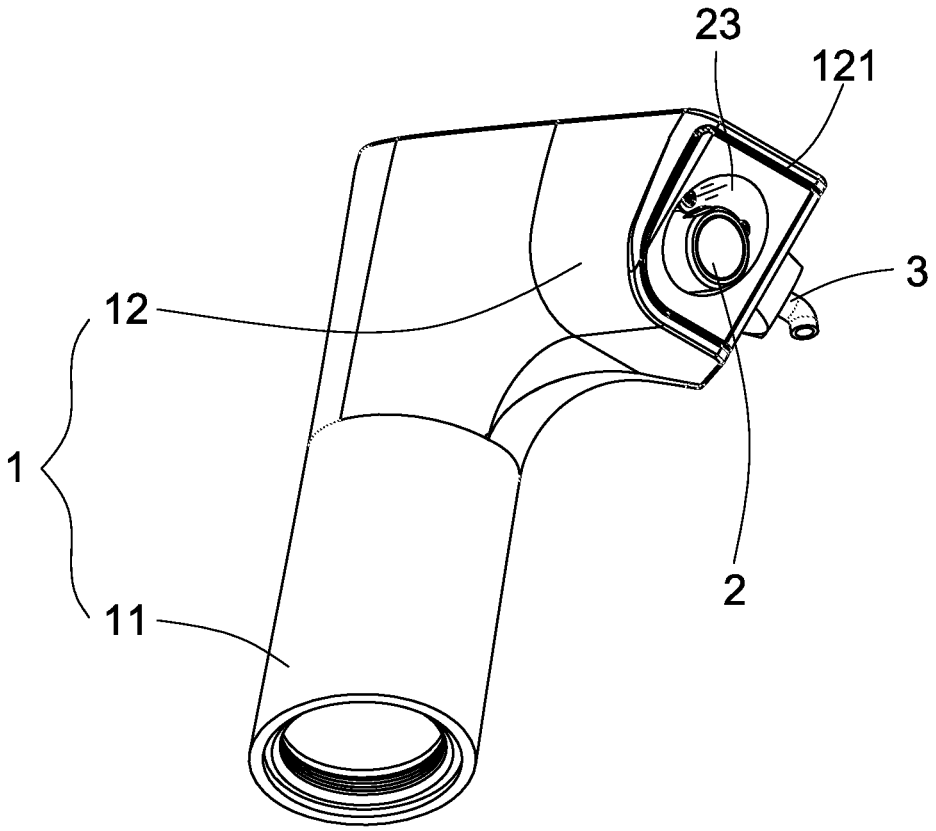
Figure 3:
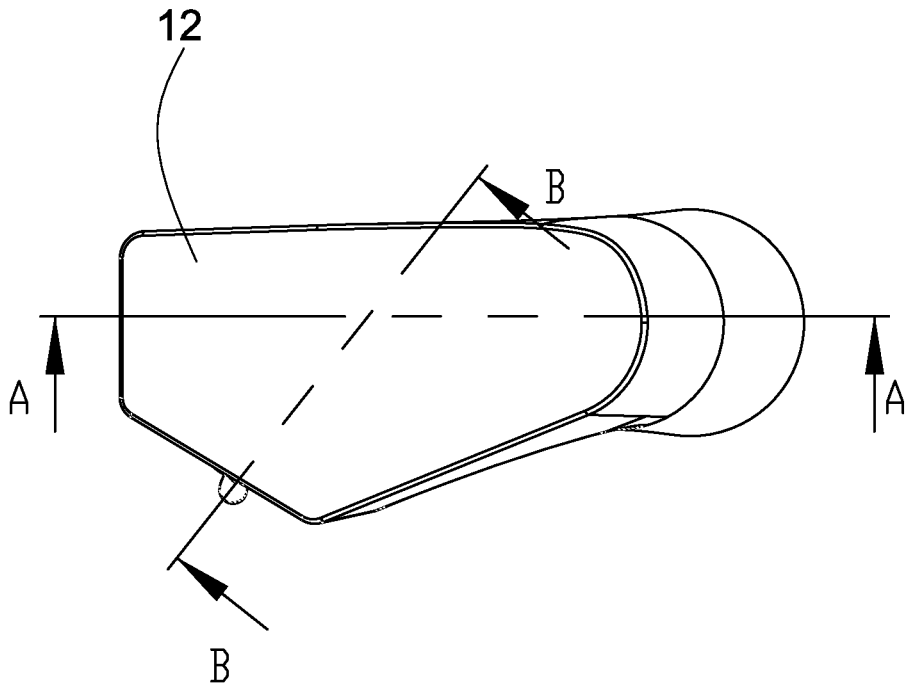
FIG. 3 is a top view of the present invention.
Figure 4:
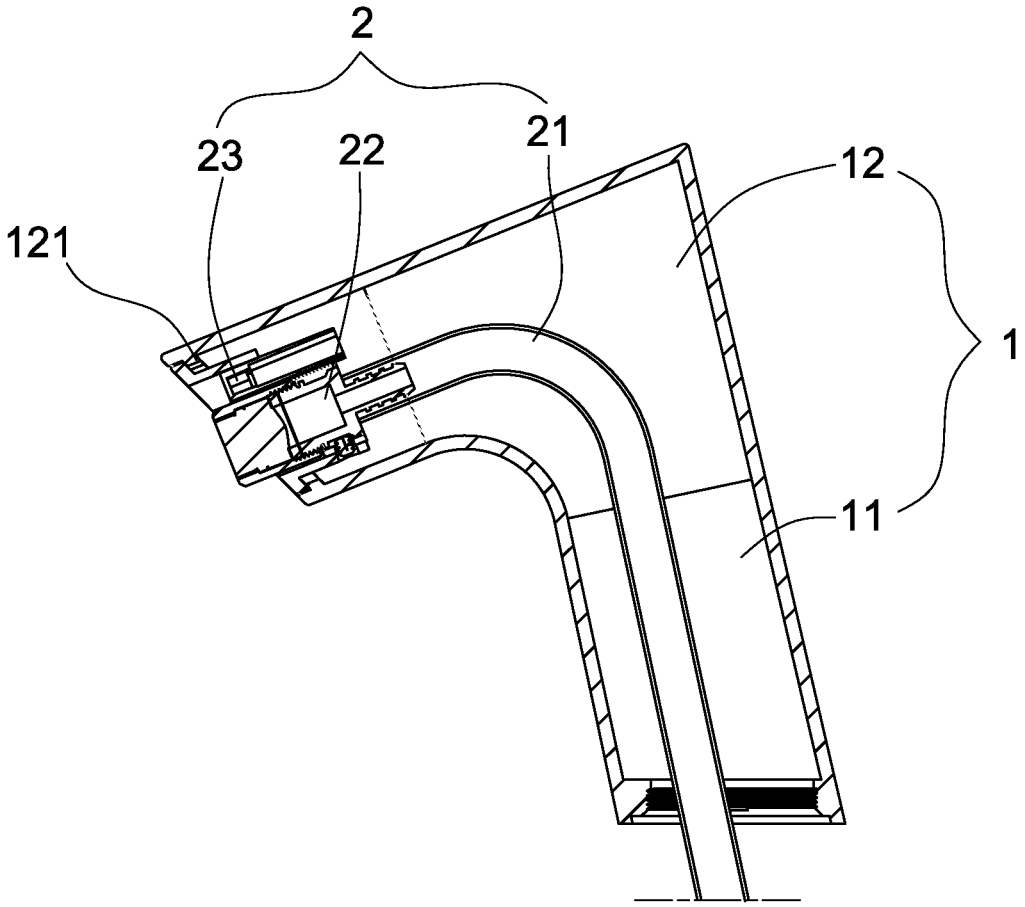
FIG. 4 is a cross-sectional view of the present invention taken along line A-A in FIG. 3.
Figure 5:
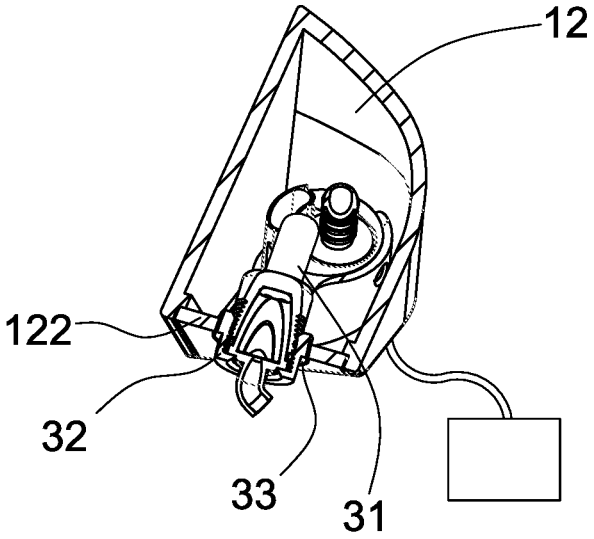
FIG. 5 is a cross-sectional view of the present invention taken along line B-B in FIG. 3.

Referring to FIGS. 1 to 5, a sensing faucet for the integration of soap supply with water outlet of the present invention mainly includes a main body 1, water supply module 2 and soap supply module 3. It is worth mentioning that the main body 1 is installed on a general single-hole hand-washing table, and users do not need to replace an existing washbasin with a new one specially for the present invention.

Referring to FIGS. 1 to 4 again, the main body 1 presents an L-like structure, and has an extension portion 11 and mounting portion 12, where the extension portion 11 is installed on a washbasin countertop, and the extension portion 11 and mounting portion 12 are structurally hollow; they can be respectively installed with at least one water supply pipe 21 and at least one soap supply pipe 31.

Continuing to refer to FIGS. 1 to 4, the mounting portion 12 has a first mounting zone 121 and second mounting zone 122, where the first mounting zone 121 is configured on the bottom of the mounting portion 12, and the second mounting zone 122 is formed into a structure with an inclined surface by obliquely cutting one side of the mounting portion 12, with an obtuse angle. being formed between the first mounting zone 121 and second mounting zone 122. The arrangement of the second mounting zone 122 is mainly designed according to users' hand washing habit; for right-handed users, they only need to reach their right hand close to one side of the second mounting zone 122, the soap liquid can ben be supplied to clean hands, conforming to the theory of human factor design.

Furthermore, the included angle between the first mounting zone 121 and second mounting zone 122 is ranged from 91° to 150°, and users stretch their hand and the soap supply can then be inducted, which conforms to most people hand washing habits.

The water supply module 2 is installed in the first mounting zone 121 and includes a water exit unit 22 and water supply sensing unit 23, where the water exit unit 22 is in connection with the water supply pipe 21 and subject to the control of the water supply sensing unit 23 to supply water or stop water.

Referring to FIGS. 1 to 5 again, the soap supply module 3 is installed on the second mounting zone 122 and includes a soap supply unit 32 and soap supply sensing unit 33, where the soap supply sensing unit 33 is used to control the soap supply unit 32 to supply soap liquid, and mixed soap fluid is supplied by the soap supply unit 32 via the soap supply pipe 31. In a preferred embodiment, the soap unit 32 may be one selected from soap supplier disclosed in Taiwan Patent No. M570110 or Taiwan Patent No. M523416, thereby providing users with fine, dense soap fluid for hand cleaning.

Figure 6:
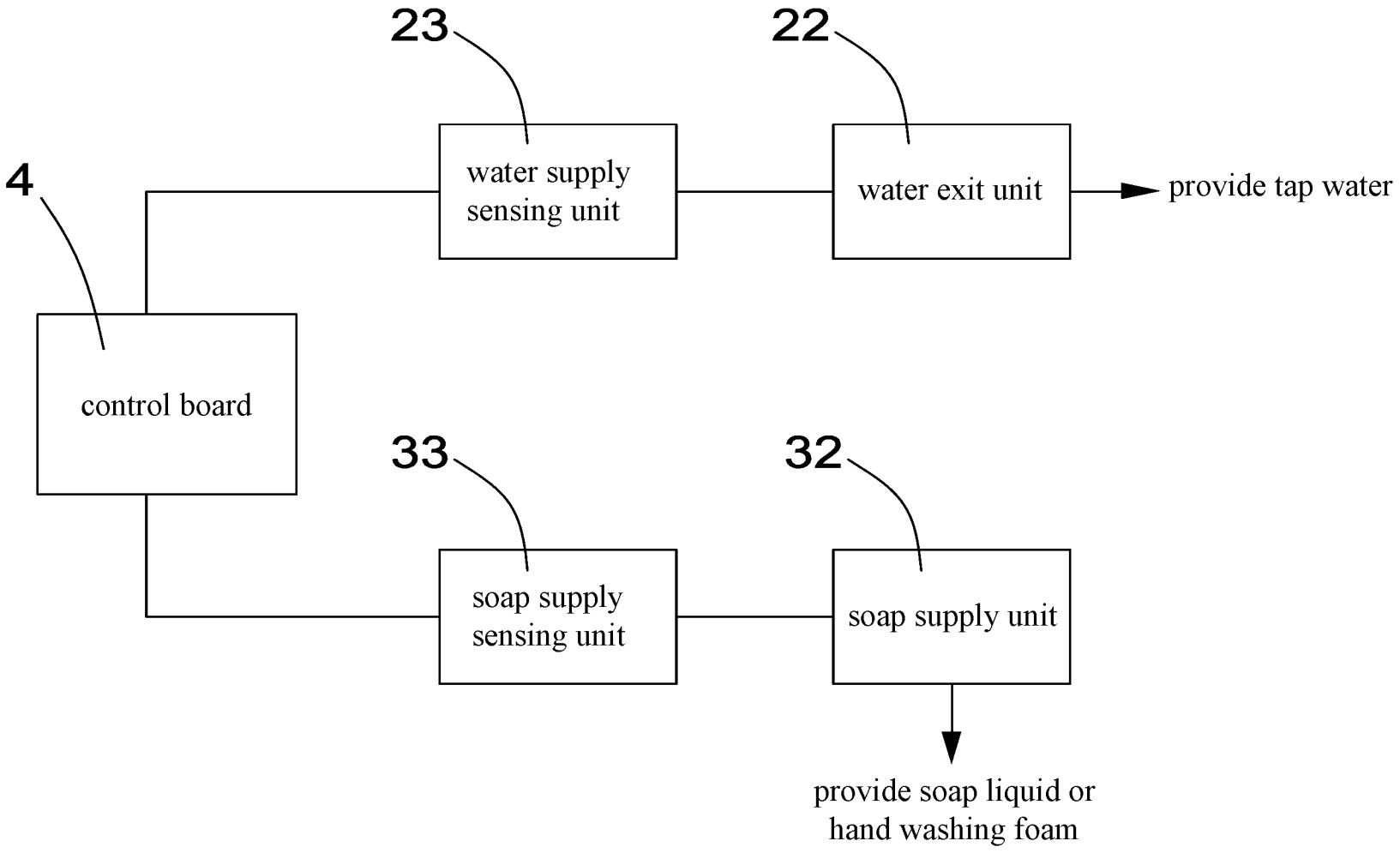
FIG. 6 is a structural control block diagram of the present invention.

With the above structure, the use of the present invention and the effects provided thereby are described in the following:

1. an installer installs the main body 1 on a table (of such as a sink or washstand) and connects the water supply pipe 21 to water supply sensing unit 22, the soap supply pipe 31 to the soap supply unit 32, and tap water or soap liquid (foam) can then be supplied to use;
2. the first mounting zone 121 of the main body 1 allows the water supply module 2 to be assembled therein and the second mounting zone 122 the soap supply module 3 to be assembled therein; the structure of the present invention shown in FIG. 1 is not too much different from conventional faucets in appearance such that consumers don't feel too awkward and other issues and there is no need for a special new washbasin or washstand, enabling consumer installment willingness thereof to be increased.
3. in actual use, a user's hand is close to one side of the soap supply module 3, and the soap supply sensing unit 33 senses the user's hand is approached and then generate a signal to command the soap supply unit 32 to provide soap liquid; the design of the second mounting zone 122 conforms to most people's hand washing habits because the mounting zone 122 is formed into a structure by cutting one side of the mounting portion 12 obliquely, and the hand does not need to touch any component, allowing hygiene can be maintained and infectious diseases can be prevent; furthermore, the entire structure of the present invention can be used with intuition without needing training.
4. when a user wants to wash hands with tap water, their hands are close to the first mounting zone 121 and can then be cleaned with tap water through the water supply sensing unit 22; and
5. referring to FIG. 6, the present invention may further configured with a control board 4 mainly adapted to control the water supply module 2 to output water or control the soap supply module 3 to provide soap liquid or hand washing foam; in addition, another use of the control board 4 is in that: when the water supply sensing unit 23 and soap supply sensing unit 33 sense at the same time that the hand (hands) is approached, tap water and soap liquid are not provide simultaneously; in another word, tap water and soap liquid are only individually supplied at any time, preventing waste.

We claim:

1. A sensing faucet for integration of a soap supply with a water exit, comprising a main body, a water supply module, and a soap supply module, said water supply module and said soap supply module installed on said main body, wherein said main body is an approximately L-shaped structure and comprises an extension portion and a mounting portion projecting in a direction away from said extension portion;

said water supply module comprises a water exit unit and a water supply sensing unit, said water exit unit in connection with a water supply pipe and controlled by said water supply sensing unit to supply water;

said soap supply module comprise a soap supply unit and a soap supply sensing unit, said soap supply sensing unit operable to control said soap supply unit to provide soap liquid, such that said soap supply unit supplies the soap liquid through a soap supply pipe; and said mounting portion of said main body is configured with a first mounting zone and second mounting zone, wherein said first mounting zone is used for the installment of said water supply module and said second mounting zone is used for the installation of said soap supply module, said second mounting zone being of a structure having an inclined surface that is formed by obliquely cutting one side of said mounting portion and faces away from said extension portion, such that an obtuse angle is formed between said first mounting zone and said second mounting zone, an included angle between a front surface of said first mounting zone that faces away from said extension portion and the inclined surface of said second mounting zone that faces away from said extension portion ranges from 91° to 150° to conform to users' hand washing intuition and habit.

* * * * *